US006375296B1

(12) United States Patent
McGarry et al.

(10) Patent No.: US 6,375,296 B1
(45) Date of Patent: Apr. 23, 2002

(54) PRINTING SYSTEM AND METHOD FOR CONTINUOUS WEB PRINT MEDIUM

(75) Inventors: Mark McGarry, San Diego; Farmid Mahtafar, Poway; Michael Klausbruckner, San Diego, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/896,599

(22) Filed: Jun. 29, 2001

(51) Int. Cl.[7] ..... B41J 2/155

(52) U.S. Cl. ..... 347/13; 347/42; 400/279; 400/708

(58) Field of Search ..... 347/12, 13, 14, 347/16, 19, 40, 42, 104, 234, 145, 180, 182; 346/136; 400/279, 708

(56) References Cited

U.S. PATENT DOCUMENTS 3,958,251 A * 5/1976 Borelli ..... 347/145
4,477,103 A 10/1984 Bertolazzi ..... 283/62
5,587,730 A * 12/1996 Karz ..... 347/43
5,839,046 A 11/1998 Takano et al. ..... 399/384
5,978,004 A 11/1999 Ehrhardt ..... 347/171
6,155,669 A * 12/2000 Donahue et al. ..... 347/42
6,234,694 B1 * 5/2001 Brookner ..... 400/76
6,260,947 B1 * 7/2001 Pinkernell ..... 347/43
6,312,099 B1 * 11/2001 Hawkins et al. ..... 347/42

* cited by examiner

*Primary Examiner*—John Barlow
*Assistant Examiner*—Blaise Mouttet

(57) ABSTRACT

An inkjet printing system for printing on a print medium having a top-of-form (TOF) indicator includes a printhead assembly, a top-of-form (TOF) detector adapted to detect the TOF indicator, a positional sensor adapted to sense a relative position of the print medium to the printhead assembly, and a controller associated with the printhead assembly, the TOF detector, and the positional sensor. The printhead assembly includes a first printhead subarray and a second printhead subarray offset from the first printhead subarray such that the controller is configured to initiate operation of the first printhead subarray after the TOF detector detects the TOF indicator and initiate operation of the second printhead subarray at a predetermined interval after the TOF detector detects the TOF indicator. As such, the predetermined interval is related to the relative position of the print medium.

28 Claims, 7 Drawing Sheets

PRINTING SYSTEM AND METHOD FOR CONTINUOUS WEB PRINT MEDIUM

THE FIELD OF THE INVENTION

The present invention relates generally to printing systems and, more particularly to a system and method for printing on a continuous web print medium.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a fixed, wide-array inkjet printing system, a plurality of individual printheads, also referred to as printhead dies, are arranged in a staggered configuration to form a printhead array which spans a nominal page width of the print medium. In addition, the printheads are fixed or held stationary relative to the print medium as the print medium is advanced during printing. With the printhead array, a number of nozzles and, therefore, an overall number of ink drops which can be ejected per second is increased. Since the overall number of drops which can be ejected per second is increased, printing speed can be increased with the wide-array inkjet printing system.

One use of the fixed, wide-array inkjet printing system is for printing on a continuous form or continuous web print medium which includes a continuous roll and/or plurality of contiguous print medium portions each representing, for example, individual sheets, forms, labels, etc. Typically, the electronic controller resets and re-initiates operation of the entire printhead array each time the printing system detects the top of one of the print medium portions.

Unfortunately, if the conventional wide-array inkjet printing system detects a subsequent print medium portion when the printing system is currently printing an image on a preceding print medium portion, the image being printed is truncated. More specifically, when the printing system detects the subsequent print medium portion, the entire printhead array is logically reset. Thus, existing or current operation of the printhead array is terminated. Those portions yet to be printed of the image currently being printed by the printing system, therefore, are not completed. More specifically, conventional inkjet printing systems cannot simultaneously initiate printing of a subsequent image and finishing the printing of a preceding image. As such, it is necessary to leave large spaces of non-printable areas of print medium between images. Thus, the margins surrounding each image printed on the print medium are undesirably large. Consequently, printing throughput is not optimized.

One attempt to prevent such image truncation is to detect only the first print medium portion and print all subsequent images relative to the first print medium portion. A disadvantage of this approach, however, is that during the course of a print run, positions of the images have a tendency to drift relative to a respective one of the print medium portions.

Accordingly, a need exists for preventing truncation of an image when printing on a continuous web print medium with a fixed, wide-array inkjet printing system. In particular, a need exists for controlling operation of the printheads of the printing system such that printheads that are printing an image continue printing the image when the printing system is triggered to print a subsequent image.

SUMMARY OF THE INVENTION

One aspect of the present invention provides an inkjet printing system adapted to print on a print medium having a top-of-form (TOF) indicator. The inkjet printing system includes a printhead assembly, a top-of-form (TOF) detector adapted to detect the TOF indicator of the print medium, a positional sensor adapted to sense a relative position of the print medium to the printhead assembly, and a controller associated with the printhead assembly, the TOF detector, and the positional sensor. The printhead assembly includes a first printhead subarray and a second printhead subarray offset from the first printhead subarray such that the controller is configured to initiate operation of the first printhead subarray after the TOF detector detects the TOF indicator and initiate operation of the second printhead subarray at a predetermined interval after the TOF detector detects the TOF indicator. As such, the predetermined interval is related to the relative position of the print medium.

Another aspect of the present invention provides a method of printing on a print medium with an inkjet printhead assembly. The print medium has a top-of-form (TOF) indicator and the inkjet printhead assembly includes a first printhead subarray and a second printhead subarray offset from the first printhead subarray. As such, the method includes detecting the TOF indicator, initiating operation of the first printhead subarray after detecting the TOF indicator, sensing a position of the print medium relative to the inkjet printhead assembly after detecting the TOF indicator, and initiating operation of the second printhead subarray based on the position of the print medium after detecting the TOF indicator.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printing system and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
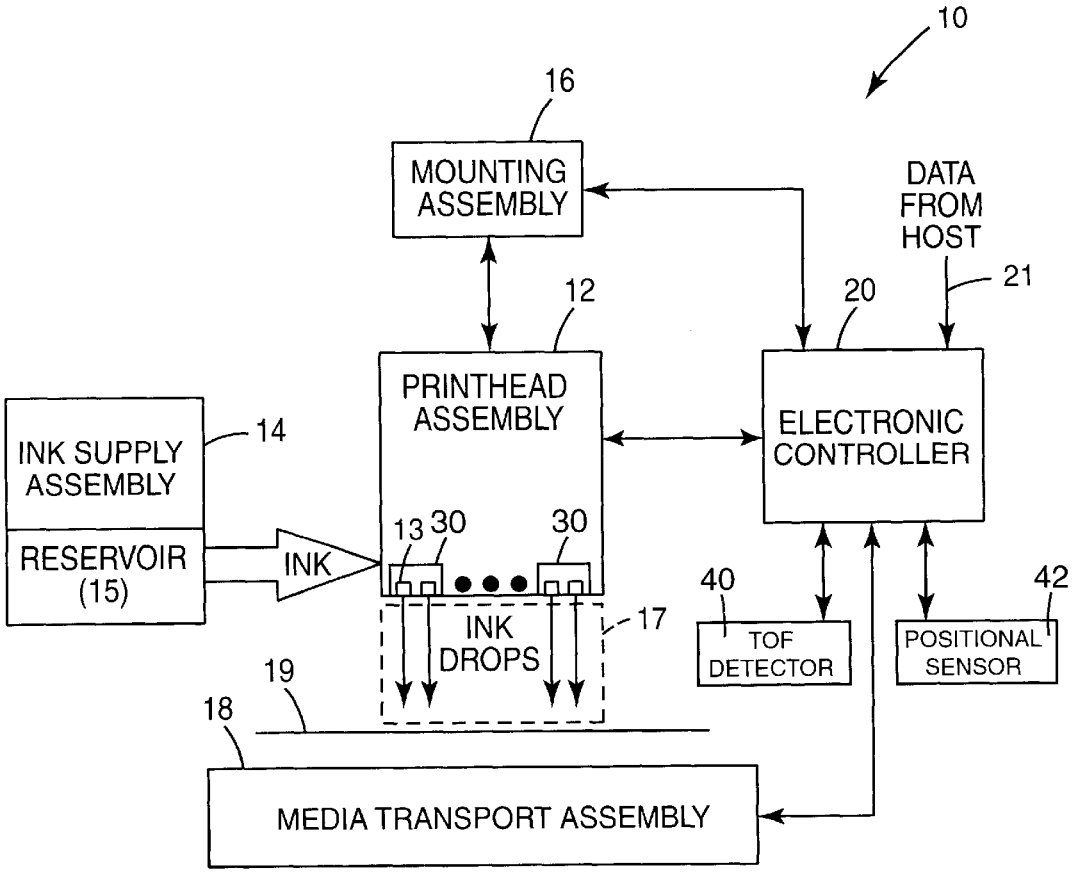
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes a plurality of printheads 30 which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 advances or positions print medium 19 relative to inkjet printhead assembly 12.

Electronic controller 20 communicates with inkjet printhead assembly 12, media transport assembly 18, and, in one embodiment, mounting assembly 16. Electronic controller 20 receives data 21 from a host system, such as a computer, and includes memory for temporarily storing data 21. Typically, data 21 is sent to inkjet printing system 10 along an electronic, infrared, optical or. other information transfer path. Data 21 represents, for example, an image, a document, and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 operates on data 21 to define a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Inkjet printing system 10 includes a detector 40 which detects a top or leading portion of print medium 19 as print medium 19 is advanced relative to inkjet printhead assembly 12 during printing. As such, detector 40 is referred to hereinafter as a top-of-form (TOF) detector. In one embodiment, TOF detector 40 detects the presence of top-of-form (TOF) marks on print medium 19, as described in detail below with reference to FIG. 2.

In one embodiment, inkjet printing system 10 also includes a positional sensor 42 which senses a position of print medium 19. More specifically, positional sensor 42 senses a position of print medium 19 relative to inkjet printhead assembly 12 as print medium 19 is advanced during printing. Positional sensor 42 includes, for example, a rotational encoder which rotates in response to advance of print medium 19 and generates a corresponding signal or pulse. As such, the rotational encoder generates, for example, a predetermined number of pulses per revolution. Thus, a number of pulses of the rotational encoder can be translated or converted into a distance of advance of print medium 19.

TOF detector 40 and positional sensor 42 communicate with controller 20. In one embodiment, TOF detector 40 and/or positional sensor 42 are associated with media transport assembly 18. TOF detector 40 and positional sensor 42, however, are fixed relative to inkjet printhead assembly 12. Positional sensor 42, for example, may be associated with a roller or other component of media transport assembly 18 which rotates or moves as print medium 19 advances or moves through inkjet printing system 10.

Figure 2:
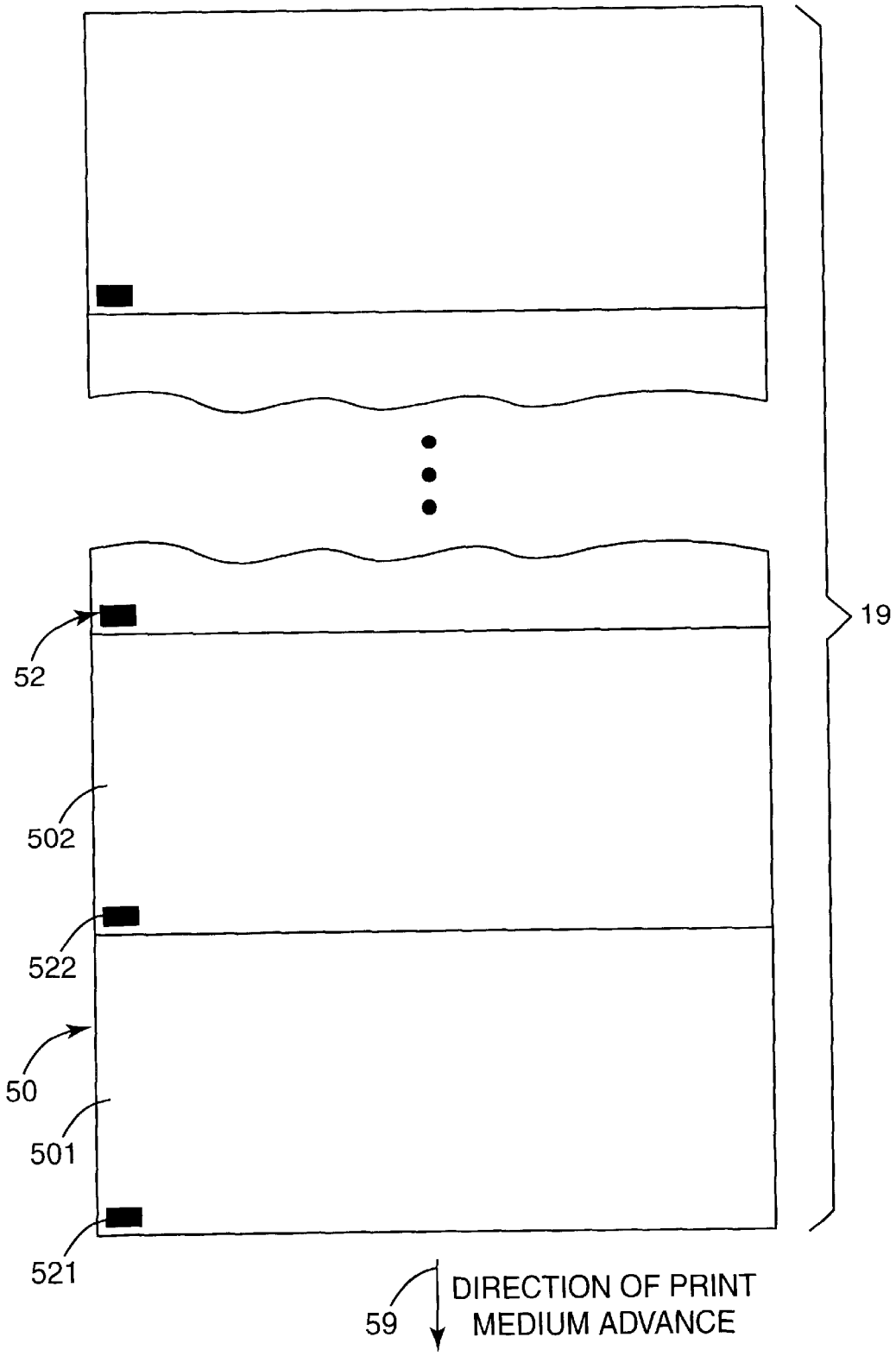
FIG. 2 is a schematic illustration of portions of a continuous web print medium according to the present invention.

As illustrated in FIG. 2, print medium 19 is a continuous form or continuous web print medium 19. As such, print medium 19 includes a plurality of contiguous print medium portions 50. Print medium portions 50 represent, for example, individual sheets, forms, labels, or the like which may be physically separated from each other by cutting or by tearing along, for example, perforated lines. In addition, print medium 19 may include a continuous roll of unprinted paper with print medium portions 50 being delineated by indicia, openings, or other markings as describe below. Since inkjet printhead assembly 12 is fixed, print medium 19 moves relative to inkjet printhead assembly 12 during printing. More specifically, print medium 19 is advanced relative to inkjet printhead assembly 12 in a direction indicated by arrow 59.

Each print medium portion 50 of print medium 19 has an indicator 52 which identifies a top or leading portion of the respective print medium portion 50. As such, indicator 52 is referred to hereinafter as a top-of-form (TOF) indicator. The top or leading portion of each print medium portion 50 includes that portion or edge of each print medium portion 50 in the direction of arrow 59. In one embodiment, print medium 19 includes, for example, a first print medium portion 501 and a second print medium portion 502 contiguous with first print medium portion 501. As such, first print medium portion 501 has a first TOF indicator 521 and second print medium portion 502 has a second TOF indicator 522. It is understood that print medium 19 may include any number of print medium portions 50 each having a respective TOF indicator 52 and that TOF indicators 52 are spaced a fixed distance relative to each other.

TOF indicator 52 of each print medium portion 50 includes, for example, any indicia, opening, or other marking, reference, or registration associated with a respective print medium portion 50. As such, TOF detector 40 of inkjet printing system 10 is designed accordingly so as to read or sense TOF indicator 52 of print medium portions 50. If, for example, TOF indicator 52 includes indicia, TOF detector 40 may include an optical sensor which visually senses TOF indicator 52. If, for example, TOF indicator 52 includes an opening, TOF detector 40 may include a probe which physically senses TOF indicator 52.

Figure 3:
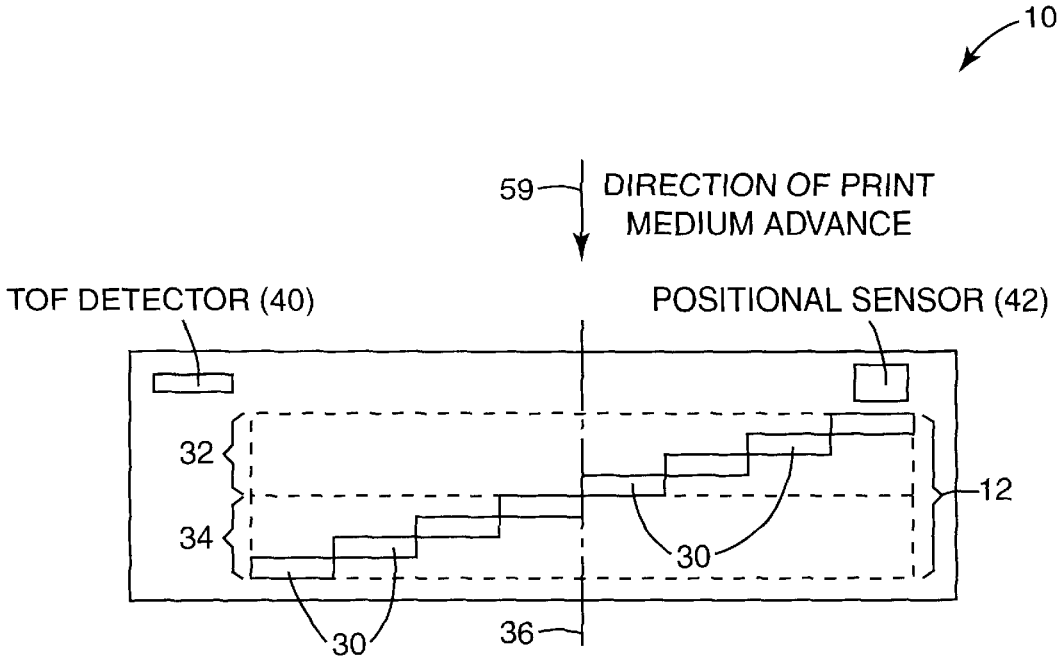
FIG. 3 is a schematic illustration of one embodiment of a portion of an inkjet printing system according to the present invention.
Figure 4:
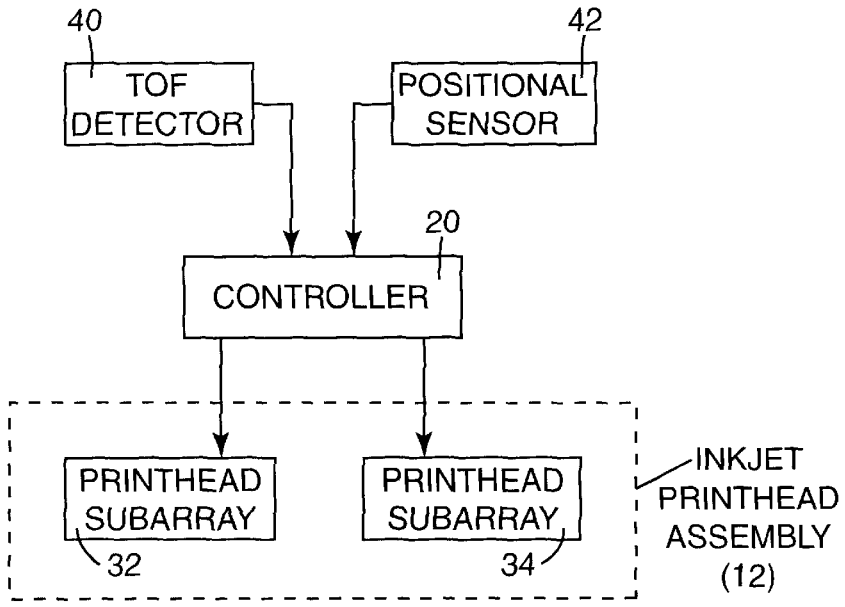
FIG. 4 is a block diagram illustrating one embodiment of a portion of an inkjet printing system according to the present invention.

FIGS. 3 and 4 illustrate one embodiment of a portion of inkjet printing system 10 including one embodiment of a portion of inkjet printhead assembly 12. Inkjet printhead assembly 12 is a fixed, wide-array or multi-head printhead assembly and includes an array or plurality of inkjet printheads 30. In one embodiment, printheads 30, also referred to as printhead dies, are spaced apart and staggered such that each printhead 30 is aligned with and/or overlaps at least one adjacent printhead 30. As such, inkjet printhead assembly 12 may span a nominal page width or a width shorter than or longer than a nominal page width. In one embodiment, printheads 30 are arranged in a stair-step manner. While inkjet printhead assembly 12 is illustrated as including eight printheads, the number of printheads may vary.

Each printhead 30 includes an array of printing or drop-ejecting elements, as is known in the art. Example embodiments of printheads 30 include a thermal printhead, a piezoelectric printhead, a flex-tensional printhead, or any other type of inkjet ejection device known in the art. In one embodiment, printheads 30 are fully integrated thermal inkjet printheads. As such, each drop ejecting element includes a nozzle opening associated with a nozzle chamber such that droplets of ink fed to the nozzle chamber are ejected through the nozzle opening and toward a print medium upon energization of a firing resistor positioned within the nozzle chamber.

Inkjet printhead assembly 12 is logically divided into multiple subarrays of inkjet printheads 30. In one embodiment, printheads 30 of inkjet printhead assembly 12 are divided into a first printhead subarray 32 and a second printhead subarray 34. Thus, inkjet printhead assembly 12 includes first printhead subarray 32 and second printhead subarray 34. First printhead subarray 32 and second printhead subarray 34, therefore, each include a plurality of printheads 30. While printheads 30 are illustrated and described as being logically divided into two printhead subarrays, it is within the scope of the present invention for printheads 30 of inkjet printhead assembly 12 to be divided into more than two printhead subarrays.

Inkjet printhead assembly 12 has an axis 36 oriented substantially parallel with a direction of advance of print medium 19 as indicated by arrow 59. In one embodiment, second printhead subarray 34 is offset from first printhead subarray 32 such that at least one printhead 30 of second printhead subarray 34 is aligned with and/or overlaps at least one printhead 30 of first printhead subarray 32. More specifically, at least one printhead 30 of second printhead subarray 34 is aligned with and/or overlaps at least one printhead 30 of first printhead subarray 32 in a direction of axis 36 as well as in a direction substantially perpendicular to axis 36. It is to be understood that FIG. 3 is a simplified schematic illustration of inkjet printing system 10, including inkjet printhead assembly 12.

In one embodiment, first printhead subarray 32, second printhead subarray 34, and TOF detector 40 are arranged, relative to axis 36 of inkjet printhead assembly 12, such that first printhead subarray 32 is positioned between TOF detector 40 and second printhead subarray 34. As such, as print medium 19 moves relative to inkjet printhead assembly 12, print medium 19 passes by TOF detector 40, first printhead subarray 32, and then second printhead subarray 34. If inkjet printhead assembly 12 includes more than two printhead subarrays, each printhead subarray is stacked in a direction of advance of print medium 19 as indicated by arrow 59.

As illustrated in FIG. 4, TOF detector 40 and positional sensor 42 each provide input to controller 20. As such, controller 20 controls operation of inkjet printhead assembly 12 based on input from TOF detector 40 and positional sensor 42. More specifically, controller 20 initiates operation of first printhead subarray 32 after TOF detector 40 detects TOF indicator 52 of print medium 19 and initiates operation of second printhead subarray 34 at a predetermined interval, as measured by positional sensor 42, after TOF detector 40 detects TOF indicator 52 of print medium 19. Detailed operation of first printhead subarray 32 and second printhead subarray 34 is described below.

Figure 5:
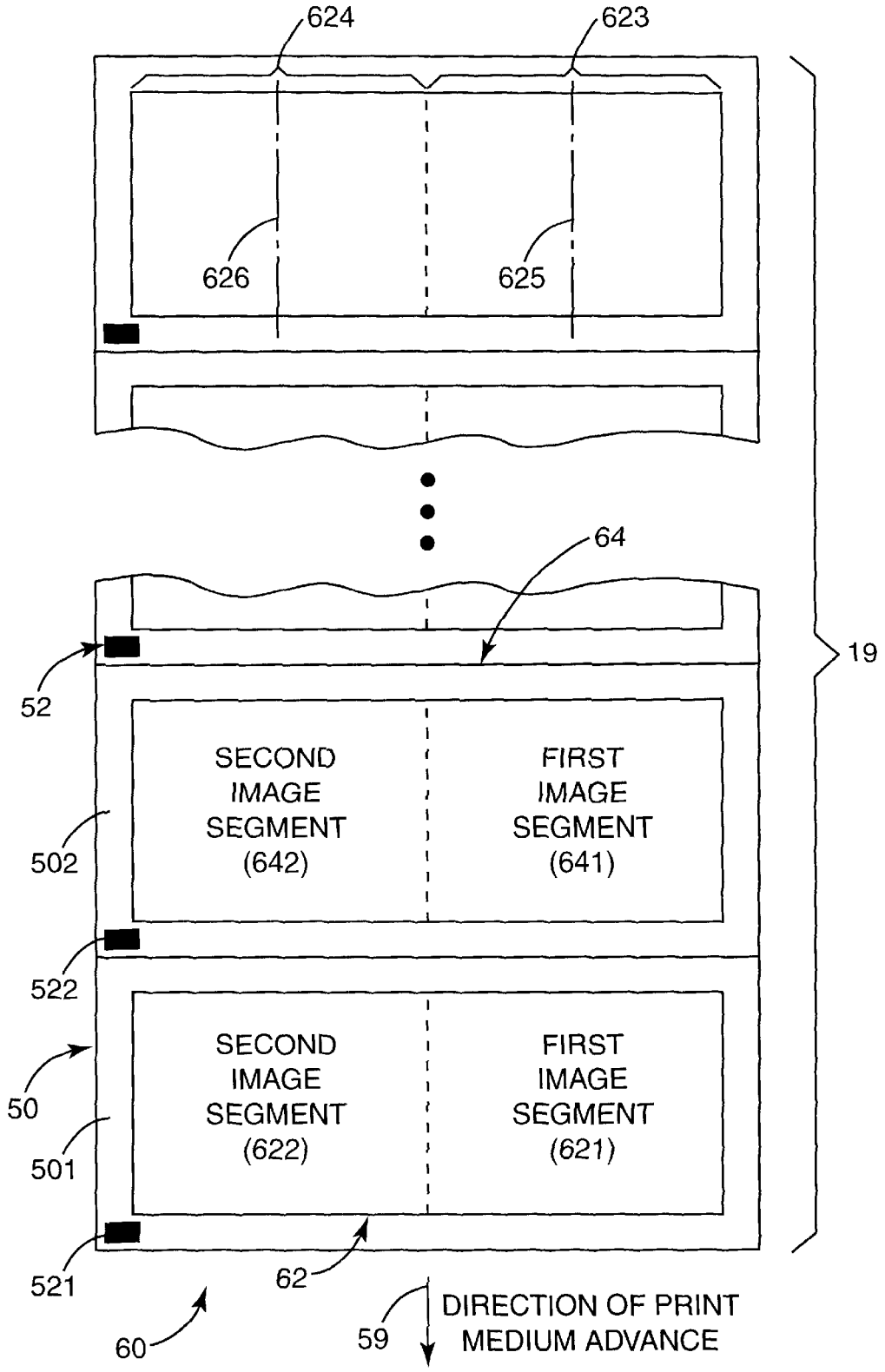
FIG. 5 is a schematic illustration of portions of the continuous web print medium of FIG. 2 including images printed by the inkjet printing system of FIG. 3.

As illustrated in FIG. 5, inkjet printing system 10, including inkjet printhead assembly 12, prints a plurality of images 60 on print medium 19. More specifically, inkjet printhead assembly 12 prints, for example, a first image 62 on first print medium portion 501 and a second image 64 on second print medium portion 502. During printing, controller 20 divides images 60 into multiple portions or segments based on the number and/or configuration of printhead subarrays.

With inkjet printhead assembly 12 divided into first printhead subarray 32 and second printhead subarray 34, controller 20 divides images 60 into two portions or segments. As such, first printhead subarray 32 and second printhead subarray 34 each print a portion or segment of first image 62 on first print medium portion 501 and a portion or segment of second image 64 on second print medium portion 502. More specifically, first printhead subarray 32 prints a first image segment 621 of first image 62 on first print medium portion 501 and a first image segment 641 of second image 64 on second print medium portion 502 and second printhead subarray 34 prints a second image segment 622 of first image 62 on first print medium portion 501 and a second image segment 642 of second image 64 on second print medium portion 502.

By logically dividing inkjet printhead assembly 12 into first printhead subarray 32 and second printhead subarray 34, controller 20 can control operation of first printhead subarray 32 independent of operation of second printhead subarray 34. For example, if TOF detector 40 detects second TOF indicator 522 of second image portion 502 while printing second image segment 622 of first image 62 with second printhead assembly 34, controller 20 initiates operation of first printhead subarray 32 to print first image segment 641 of second image 64 and continues operation of second printhead subarray 34 to finish printing of second image segment 622 of first image 62.

First image segments 621 and 641 each include a first print swath 623 and second image segments 622 and 642 each include a second print swath 624. First print swath 623 has an axis 625 oriented substantially parallel with the direction of print medium advance indicated by arrow 59 and second print swath 624 has an axis 626 oriented substantially parallel with axis 625 of first print swath 623 and oriented substantially parallel with the direction of print medium advance indicated by arrow 59.

Figure 6:
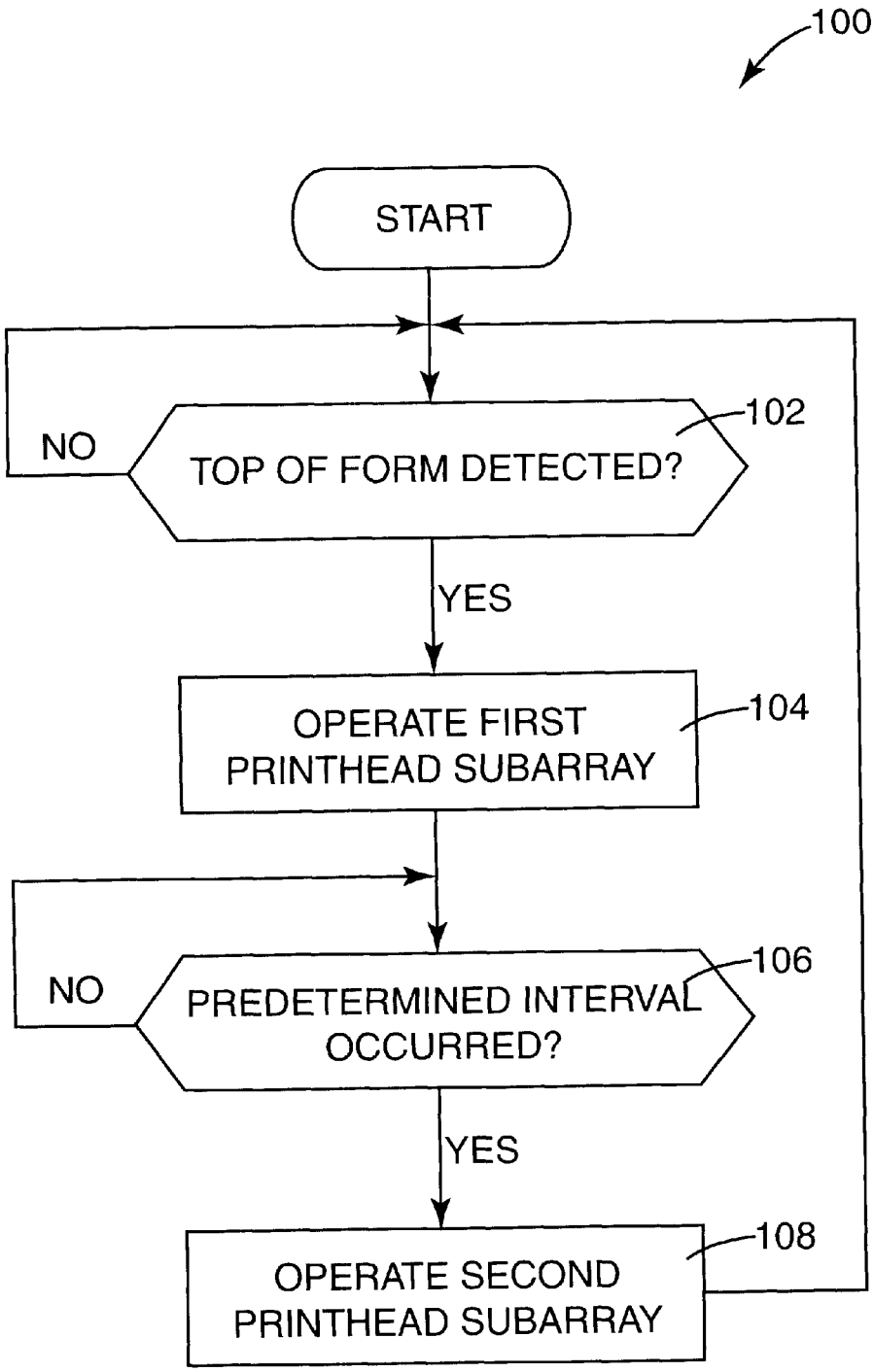
FIG. 6 is a flow diagram illustrating one embodiment of a method of printing according to the present invention.

FIG. 6 illustrates one embodiment of a method 100 of printing on print medium 19 with inkjet printing system 10. Reference is also made to FIGS. 1–5. At step 102, whether the top of print medium 19 is detected is assessed. More specifically, whether a TOF indicator 52 of a print medium portion 50 of print medium 19 is detected is assessed. Detection of TOF indicator 52 is performed by TOF detector 40, as described above, and is input to controller 20. If TOF detector 40 does not detect TOF indicator 52 method 100 returns. If, however, TOF detector 40 does detect TOF indicator 52, for example, TOF indicator 521 of first print medium portion 501, method 100 proceeds to step 104.

At step 104, after TOF detector 40 detects TOF indicator 52, operation of first printhead subarray 32 is initiated. More specifically, controller 20 controls operation of first printhead subarray 32 to print, for example, first image segment 621 of first image 62 on first print medium portion 501 of print medium 19. While operation of first printhead subarray 32 is illustrated and described as occurring after detecting TOF indicator 52, it is understood that operation of first printhead subarray 32 may be initiated instantaneously after detecting TOF indicator 52 and/or following a delay after detecting TOF indicator 52. Regardless, operation of first printhead subarray 32 is initiated after detecting TOF indicator 52 of print medium 19.

At step 106, whether a predetermined interval after detecting TOF indicator 52 of print medium 19 has occurred is assessed. More specifically, whether print medium 19 has advanced a predetermined distance relative to TOF indicator 52 has occurred is assessed. In one embodiment, the predetermined interval is assessed by positional sensor 42. If, for example, positional sensor 42 is a rotational encoder, as described above, the predetermined interval is measured as a predetermined number of pulses generated by the rotational encoder following the detection of TOF indicator 52. As such, the number of pulses generated by the rotational encoder can be converted into a position of print medium 19 relative to inkjet printhead assembly 12 as measured from TOF indicator 52.

Whether the predetermined interval after detecting TOF indicator 52 of print medium 19 has occurred is assessed in step 106 before, during, and/or after initiation of operation of first printhead subarray 32 in step 104. If the predetermined interval has not occurred, method 100 returns. If, however, the predetermined interval has occurred, method 100 proceeds to step 108.

At step 108, at the predetermined interval after detecting TOF indicator 52 of print medium 19, as assessed in step 106, operation of second printhead subarray 34 is initiated. More specifically, controller 20 controls operation of second printhead subarray 34 to print, for example, second image segment 622 of first image 62 on first print medium portion 501 of print medium 19. Operation of second printhead subarray 34, therefore, is initiated at a predetermined interval after detecting TOF indicator 52 of print medium 19.

In one embodiment, during and/or after initiation of operation of second printhead subarray 34 in step 108, method 100 returns to step 102. As such, whether a subsequent TOF indicator 52 of a subsequent print medium portion 50 of print medium 19 is detected is assessed. For example, if TOF detector 40 has detected TOF indicator 521 of first print medium portion 501 and first image 62 has been or is being printed on first print medium portion 501 of print medium 19, whether second TOF indicator 522 of second print medium portion 502 is detected is assessed.

After second TOF indicator 522 of second print medium portion 502 is detected, controller 20 initiates operation of first printhead subarray 32, as outlined in step 104. More specifically, controller 20 initiates operation of first printhead subarray 32 to print, for example, first image segment 641 of second image 64 on second image portion 502 of print medium 19. However, if, for example, second image segment 622 of first image 62 is being printed on first image portion 501 of print medium 19 by second printhead subarray 34, operation of second printhead subarray 34 is continued to complete first image 62.

At the predetermined interval after detecting second TOF indicator 522 of second print medium portion 502, as assessed in step 106, controller 20 initiates operation of second printhead subarray 34, as outlined in step 108. More specifically, controller 20 initiates operation of second printhead subarray 34 to print, for example, second image segment 642 of second image 64 on second print medium portion 502 of print medium 19. To continue printing additional images, method 100 returns to step 102, as described above.

Figure 7:
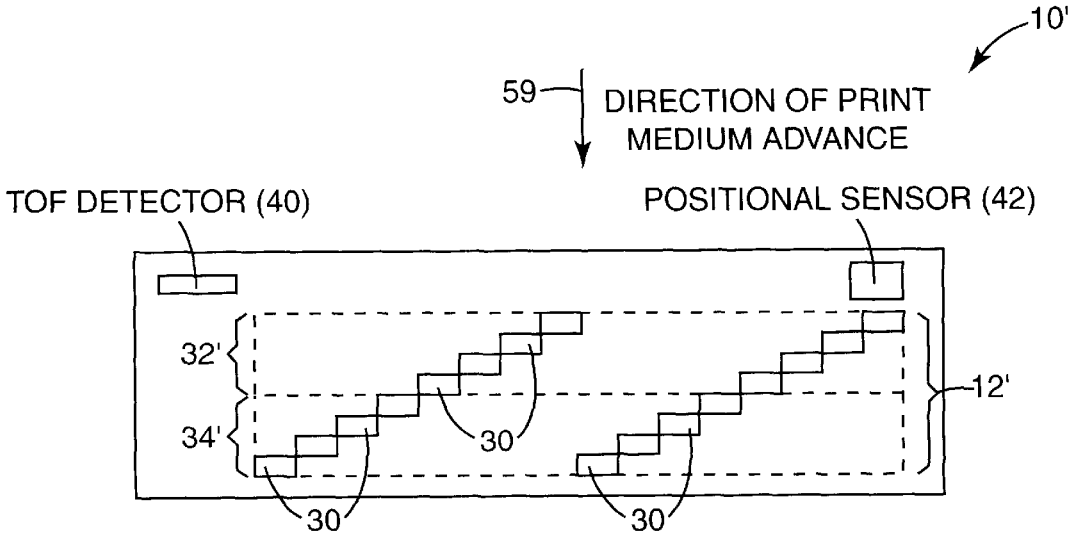
FIG. 7 is a schematic illustration of another embodiment of a portion of an inkjet printing system according to the present invention.

FIG. 7 illustrates another embodiment of a portion of inkjet printing system 10. Inkjet printing system 10' is similar to inkjet printing system 10 and includes TOF detector 40 and positional sensor 42. Inkjet printing system 10', however, includes another embodiment of a portion of inkjet printhead assembly 12. Inkjet printhead assembly 12', similar to inkjet printhead assembly 12, includes a first printhead subarray 32' and a second printhead subarray 34'. First printhead subarray 32' and second printhead subarray 34', however, each include a pair of spaced arrays of inkjet printheads 30.

Figure 8:
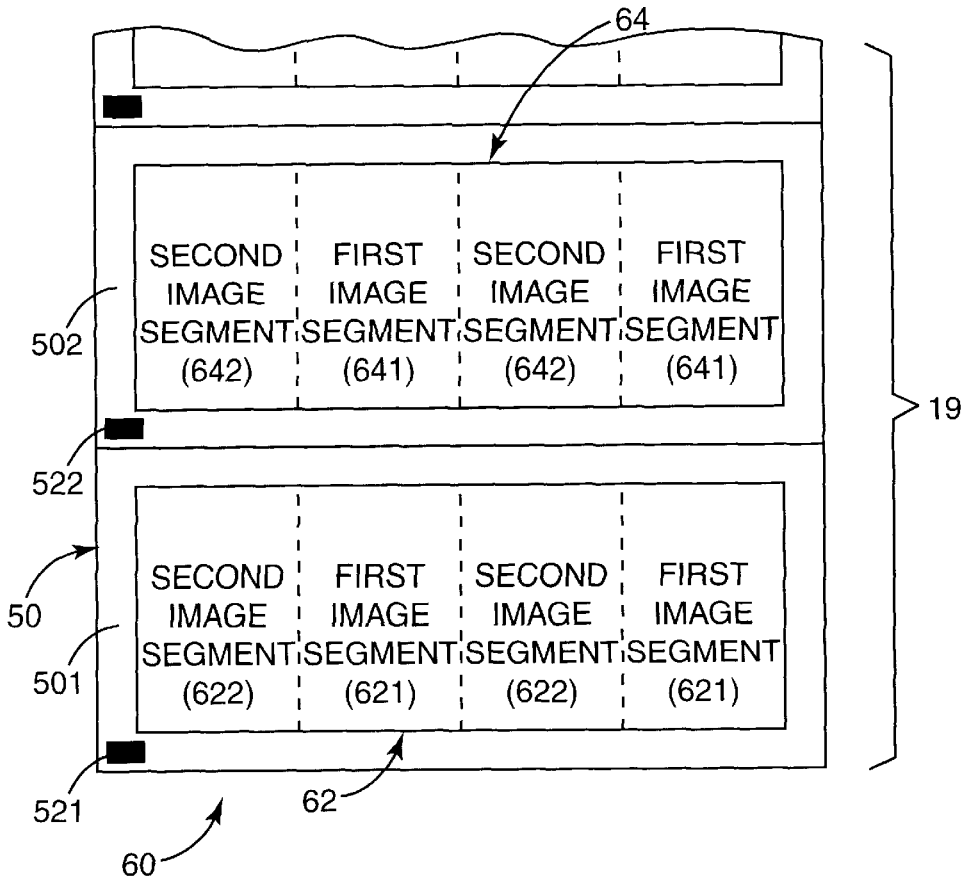
FIG. 8 is a schematic illustration of portions of a continuous web print medium including images printed by the inkjet printing system of FIG. 7.

As illustrated in FIG. 8, inkjet printing system 10', including inkjet printhead assembly 12', prints images 60 on print medium 19. With inkjet printhead assembly 12' divided into first printhead subarray 32' and second printhead subarray 34' and first printhead subarray 32' and second printhead subarray 34' each including a pair of spaced arrays of inkjet printheads 30, first printhead subarray 32' and second printhead subarray 34' each print spaced portions or segments of first image 62 on first print medium portion 501 and spaced portions or segments of second image 64 on second print medium portion 502. As such, first printhead subarray 32' prints a pair of first image segments 621 of first image 62 and a pair of first image segments 641 of second image 64 and second printhead subarray 34' prints a pair of second image segments 622 of first image 62 and a pair of second image segments 642 of second image 64.

Figure 9:
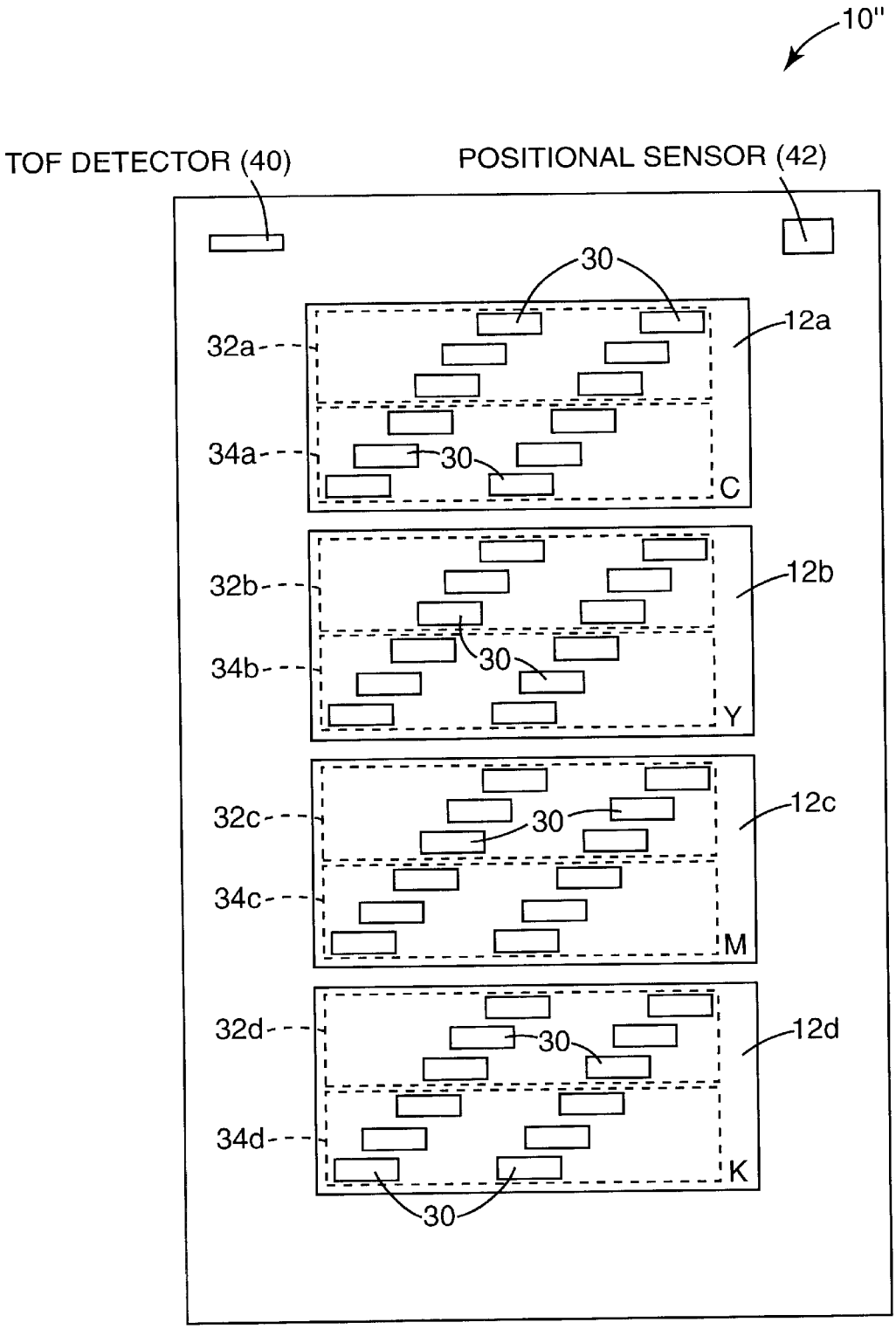
FIG. 9 is a schematic illustration of another embodiment of a portion of an inkjet printing system according to the present invention.

FIG. 9 illustrates another embodiment of a portion of inkjet printing system 10. Inkjet printing system 10" is similar to inkjet printing systems 10 and 10" and includes TOF detector 40 and positional sensor 42. Inkjet printing system 10", however, includes a plurality of inkjet printhead assemblies 12. More specifically, inkjet printing system 10" includes inkjet printhead assemblies 12*a*, 12*b*, 12*c*, and 12*d*.

Each inkjet printhead assembly 12*a*, 12*b*, 12*c*, and 12*d* is similar to inkjet printhead assembly 12 and, in one embodiment, inkjet printhead assembly 12', and includes a first printhead subarray 32*a*, 32*b*, 32*c*, and 32*d*, respectively, and a second printhead subarray 34*a*, 34*b*, 34*c*, and 34*d*, respectively. As such, controller 20 initiates operation of first printhead subarray 32*a* of inkjet printhead assembly 12*a* after TOF detector 40 detects TOF indicator 52 and initiates operation of second printhead subarray 34*a* of inkjet printhead assembly 12*a* at a predetermined interval after TOF detector 40 detects TOF indicator 52. In addition, controller 20 initiates operation of first and second printhead subarrays 32*b* and 34*b* of inkjet printhead assembly 12*b* at predetermined intervals after TOF detector 40 detects TOF indicator 52, initiates operation of first and second printhead subarrays 32*c* and 34*c* of inkjet printhead assembly 12*c* at predetermined intervals after TOF detector 40 detects TOF indicator 52, and initiates operation of first and second printhead subarrays 32*d* and 34*d* of inkjet printhead assembly 12*d* at predetermined intervals after TOF detector 40 detects TOF indicator 52.

In one illustrative embodiment, inkjet printhead assemblies 12*a*, 12*b*, 12*c*, and 12*d* print differing colors of ink on print medium 19. For example, inkjet printhead assembly 12*a* prints cyan (C) ink, inkjet printhead assembly 12*b* prints yellow (Y) ink, inkjet printhead assembly 12*c* prints magenta (M) ink, and inkjet printhead assembly 12*d* prints black (K) ink.

By logically dividing printheads 30 of inkjet printhead assembly 12 into multiple printhead subarrays, inkjet printing system 10 prevents truncation of an image when printing on a continuous web print medium. More specifically, by dividing inkjet printhead assembly 12 into, for example, first printhead subarray 32 and second printhead subarray 34, inkjet printing system 10 can control operation of printheads 30 of inkjet printhead assembly 12 such that printheads 30 that are printing an image, for example, first image 62, continue printing the image when inkjet printhead assembly 12 is triggered to print a subsequent image, for example, second image 64.

In addition, by logically dividing printheads 30 of inkjet printhead assembly 12 into multiple printhead subarrays, inkjet printing system 10 can simultaneously print portions of adjacent images. More specifically, inkjet printing system 10 can start to print a subsequent image, for example, second image 64, while finishing the printing of a preceding image, for example, first image 62. As such, it is not necessary to leave large spaces of non-printable areas of print medium portions 50 between images. Thus, margins of print medium portions 50 can be reduced whereby inkjet printing system 10 can print closer to the top and/or the bottom of print medium portions 50. Furthermore, since portions of adjacent images can be printed simultaneously, throughput can be increased with inkjet printing system 10.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printing system, comprising:

a printhead assembly including a first printhead subarray and a second printhead subarray offset from the first printhead subarray;

a top-of-form (TOF) detector adapted to detect a TOF indicator of a print medium;

a positional sensor adapted to sense a relative position of the print medium to the printhead assembly; and a controller associated with the printhead assembly, the TOF detector, and the positional sensor, wherein the controller is configured to initiate operation of the first printhead subarray after the TOF detector detects the TOF indicator and initiate operation of the second printhead subarray at a predetermined interval after the TOF detector detects the TOF indicator, wherein the predetermined interval is related to the relative position of the print medium.

2. The inkjet printing system of claim 1, wherein the printhead assembly has an axis adapted to be oriented substantially parallel with a direction of advance of the print medium, and wherein, relative to the axis of the printhead assembly, the first printhead subarray is positioned between the TOF detector and the second printhead subarray.

3. The inkjet printing system of claim 1, wherein the printhead assembly is configured to be stationary relative to advance of the print medium.

4. The inkjet printing system of claim 1, wherein the first printhead subarray and the second printhead subarray are adapted to print an image on the print medium, and wherein the first printhead subarray is adapted to print a first image segment of the image and the second printhead subarray is adapted to print a second image segment of the image.

5. The inkjet printing system of claim 4, wherein the first image segment includes a first print swath having an axis adapted to be oriented substantially parallel with a direction of advance of the print medium, and wherein the second image segment includes a second print swath having an axis adapted to be oriented substantially parallel with the axis of the first print swath and the direction of advance of the print medium.

6. The inkjet printing system of claim 1, wherein the first printhead subarray includes a first plurality of inkjet printheads and the second printhead subarray includes a second plurality of inkjet printheads, and wherein the first plurality of inkjet printheads are offset relative to each other and the second plurality of inkjet printheads are offset relative to each other.

7. The inkjet printing system of claim 1, wherein the print medium is a continuous web print medium including a first portion having a first TOF indicator and a second portion having a second TOF indicator, wherein the TOF detector is adapted to detect the first TOF indicator and the second TOF indicator, and wherein the controller is configured to initiate operation of the first printhead subarray after the TOF detector detects the first TOF indicator and after the TOF detector detects the second TOF indicator, and wherein the controller is configured to initiate operation of the second printhead subarray at a predetermined interval after the TOF detector detects the first TOF indicator.

8. The inkjet printing system of claim 7, wherein the inkjet printing system is adapted to print a first image on the first portion of the print medium and a second image on the second portion of the print medium, wherein the inkjet printing system is adapted to simultaneously print a portion of the first image and a portion of the second image.

9. The inkjet printing system of claim 7, wherein the inkjet printing system is adapted to print a first image on the first portion of the print medium and a second image on the second portion of the print medium, wherein the inkjet printing system is adapted to print a portion of the first image after a portion of the second image has been printed.

10. The inkjet printing system of claim 7, wherein the controller is configured to continue operation of the second printhead subarray after the TOF detector detects the second TOF indicator.

11. The inkjet printing system of claim 7, wherein the controller is configured to initiate operation of the second printhead subarray at a predetermined interval after the TOF detector detects the second TOF indicator.

12. A method of printing on a print medium having a top-of-form (TOF) indicator with an inkjet printhead assembly including a first printhead subarray and a second printhead subarray offset from the first printhead subarray, the method comprising:

detecting the TOF indicator;

initiating operation of the first printhead subarray after detecting the TOF indicator;

sensing a position of the print medium relative to the inkjet printhead assembly after detecting the TOF indicator; and initiating operation of the second printhead subarray based on the position of the print medium after detecting the TOF indicator.

13. The method of claim 12, further comprising:

fixing the inkjet printhead assembly; and advancing the print medium relative to the inkjet printhead assembly.

14. The method of claim 12, further comprising:

printing a first image on the print medium with the first printhead subarray and the second printhead subarray, wherein initiating operation of the first printhead subarray includes printing a first image segment of the first image, and wherein initiating operation of the second printhead subarray includes printing a second image segment of the first image.

15. The method of claim 14, wherein printing the first image segment of the first image includes printing a first print swath having an axis adapted to be oriented substantially parallel with a direction of advance of the print medium, and wherein printing the second image segment of the first image includes printing a second print swath having an axis adapted to be oriented substantially parallel with the axis of the first print swath and the direction of advance of the print medium.

16. The method of claim 14, further comprising:

printing a second image on the print medium with the first printhead subarray and the second printhead subarray, wherein initiating operation of the first printhead subarray and initiating operation of the second printhead subarray include simultaneously printing a portion of the second image segment of the first image and a portion of a first image segment of the second image.

17. The method of claim 14, further comprising:

printing a second image on the print medium with the first printhead subarray and the second printhead subarray, wherein initiating operation of the first printhead subarray and initiating operation of the second printhead subarray include printing a portion of the second image segment of the first image after printing a portion of a first image segment of the second image.

18. The method of claim 12, wherein the print medium is a continuous web print medium including a first portion having a first TOF indicator and a second portion having a second TOF indicator, wherein detecting the TOF indicator includes detecting the first TOF indicator and subsequently detecting the second TOF indicator, wherein initiating operation of the first printhead subarray and initiating operation of the second printhead subarray include initiating operation of the first printhead subarray after detecting the first TOF indicator and after detecting the second TOF indicator and initiating operation of the second printhead subarray based on a position of the print medium after detecting the first TOF indicator.

19. The method of claim 18, further comprising:

continuing operation of the second printhead subarray after detecting the second TOF indicator.

20. The method of claim 18, wherein initiating operation of the second printhead subarray further includes initiating operation of the second printhead subarray based on a position of the print medium after detecting the second TOF indicator.

21. The method of claim 12, wherein the first printhead subarray includes a first plurality of inkjet printheads and the second printhead subarray includes a second plurality of inkjet printheads, and wherein initiating operation of the first printhead subarray includes initiating operation of at least one of the first plurality of inkjet printheads and initiating operation of the second printhead subarray includes initiating operation of at least one of the second plurality of inkjet printheads.

22. The method of claim 12, wherein sensing the position of the print medium includes gauging a predetermined interval after detecting the TOF indicator, and wherein initiating operation of the second printhead subarray includes initiating operation of the second printhead subarray at the predetermined interval after detecting the TOF indicator.

23. A method of printing on a continuous web print medium including a first portion having a first top-of-form (TOF) indicator and a second portion having a second TOF indicator with an inkjet printhead assembly including a first printhead subarray and a second printhead subarray offset from the first printhead subarray, the method comprising:

detecting the first TOF indicator;

initiating operation of the first printhead subarray after detecting the first TOF indicator;

waiting a predetermined interval after detecting the first TOF indicator;

initiating operation of the second printhead subarray after the predetermined interval after detecting the first TOF indicator;

detecting the second TOF indicator; and continuing operation of the second printhead subarray after detecting the second TOF indicator.

24. The method of claim 23, further comprising:

initiating operation of the first printhead subarray after detecting the second TOF indicator;

waiting a predetermined interval after detecting the second TOF indicator; and initiating operation of the second printhead subarray after the predetermined interval after detecting the second TOF indicator.

25. The method of claim 24, wherein initiating operation of the first printhead subarray after detecting the first TOF indicator includes printing a first segment of a first image on the first portion of the print medium, and wherein initiating operation of the second printhead subarray after the predetermined interval after detecting the first TOF indicator includes printing a second segment of the first image on the first portion of the print medium.

26. The method of claim 25, wherein continuing operation of the second printhead subarray after detecting the second TOF indicator includes printing a portion of the second segment of the first image on the first portion of the print medium.

27. The method of claim 26, wherein initiating operation of the first printhead subarray after detecting the second TOF indicator includes printing a first segment of a second image on the second portion of the print medium, and wherein initiating operation of the second printhead subarray after the predetermined interval after detecting the second TOF indicator includes printing a second segment of the second image on the second portion of the print medium.

28. The method of claim 24, wherein waiting the predetermined interval after detecting the first TOF indicator and waiting the predetermined interval after detecting the second TOF indicator each include sensing a relative position of the print medium to the inkjet printhead assembly, and wherein initiating operation of the second printhead subarray after the predetermined interval after detecting the first TOF indicator and initiating operation of the second printhead subarray after the predetermined interval after detecting the second TOF indicator each include initiating operation of the second printhead subarray based on the relative position of the print medium.

* * * * *